US009009979B2

(12) United States Patent
De Buyer-Mimeure

(10) Patent No.: US 9,009,979 B2
(45) Date of Patent: Apr. 21, 2015

(54) FOLDING BLADE KNIFE WITH A SYSTEM FOR LOCKING THE BLADE IN AN UNFOLDING POSITION

(71) Applicant: Wildsteer, L'Etrat (FR)

(72) Inventor: Edouard De Buyer-Mimeure, L'Etrat (FR)

(73) Assignee: Wildsteer, L'Etrat (FR)

( * ) Notice: Subject to any disclaimer, the term of this patent is extended or adjusted under 35 U.S.C. 154(b) by 207 days.

(21) Appl. No.: 13/765,092

(22) Filed: Feb. 12, 2013

(65) Prior Publication Data

US 2013/0212887 A1 Aug. 22, 2013

(30) Foreign Application Priority Data

Feb. 21, 2012 (FR) ..... 12 51562

(51) Int. Cl.
*B26B 3/06* (2006.01)
*B26B 1/04* (2006.01)

(52) U.S. Cl.
CPC .. *B26B 1/04* (2013.01); *B26B 1/042* (2013.01)

(58) Field of Classification Search
CPC ..... B26B 1/00; B26B 1/02; B26B 1/04; B26B 1/042; B26B 1/044; B26B 1/046; B26B 1/048; B26B 1/06; B26B 1/08; B26B 1/10
USPC ..... 30/151–161, 330–331, 337–339; 7/118–120
See application file for complete search history.

(56) References Cited

U.S. PATENT DOCUMENTS

| | | | | |
|---|---|---|---|---|
| 1,373,993 | A * | 4/1921 | Boe | 30/161 |
| 4,563,813 | A * | 1/1986 | Fortenberry | 30/161 |
| 7,600,322 | B2 * | 10/2009 | Kao | 30/151 |
| 7,634,858 | B1 * | 12/2009 | Frazer | 30/2 |
| 7,748,122 | B2 * | 7/2010 | Duey | 30/159 |
| 7,913,398 | B2 * | 3/2011 | Chu | 30/161 |
| 8,832,943 | B2 * | 9/2014 | Sakai | 30/146 |
| 2005/0194238 | A1 * | 9/2005 | Frazer | 200/48 A |
| 2009/0193664 | A1 | 8/2009 | Galyean | |
| 2013/0047439 | A1 * | 2/2013 | Hawk et al. | 30/160 |

FOREIGN PATENT DOCUMENTS

| | | | |
|---|---|---|---|
| DE | 20 2009 008278 | U1 | 9/2009 |
| FR | 2 732 637 | A1 | 10/1996 |
| FR | 2 782 287 | A1 | 2/2000 |

OTHER PUBLICATIONS

Search Report for priority French Application No. FR 1251562, dated Sep. 25, 2012.

* cited by examiner

*Primary Examiner* — Ned Landrum
*Assistant Examiner* — Liang Dong
(74) *Attorney, Agent, or Firm* — Heslin Rothenberg Farley & Mesiti P.C.

(57) ABSTRACT

A system for locking a blade of a knife with a folding blade in an unfolded position includes a handle-forming part for a user to grasp, and a blade pivotably mounted relative to this handle-forming part. The blade pivots to adopt either an unfolded position for use, or a foldaway position for storage, wherein it is partially concealed in the handle-forming part. A first locking element on a top of the knife, cooperates with the blade and adopts a first position of locking the blade in the unfolded position and a second release position of the blade A second locking element cooperating with the first locking element, adopts a first position of locking the first locking element in the first locking position of the blade, and a second release position wherein the second locking element forces the first locking element to adopt the second release position of the blade.

5 Claims, 3 Drawing Sheets

FOLDING BLADE KNIFE WITH A SYSTEM FOR LOCKING THE BLADE IN AN UNFOLDING POSITION

CROSS REFERENCE TO RELATED APPLICATIONS

This application claims priority of French application number 1251562 filed on Feb. 21, 2012, the entire contents of which is hereby incorporated by reference herein.

TECHNICAL FIELD

This invention relates to the technical field of cutlery instruments and in particular to the technical field of folding blade knives. The invention relates more specifically to a system for blade locking in the unfolded position for a folding blade knife.

The invention can be used to particular advantage in the field of so-called "outdoor" knives, survival knives and tactical knives.

PRIOR ART

In the current state of the art, there is a plurality of solutions for locking the blade of a folding blade knife in the unfolded position.

A first technique comprises for example a blade locking system using friction, wherein it is only the friction of the blade against the plates of the handle-forming part which locks the knife blade in the unfolded position. On some knife models, a pivot screw is used for the blade and it is then possible to tighten the pin to adjust the required friction. This technique is not entirely satisfactory, and blade locking is not optimum.

A second technique comprises hooking the upper part of the blade heel by a metal rod inserted between the plates, in the upper part. The blade is thus fully locked. For it to be released, it is necessary to actuate a spring placed on the back or at the back of the handle, which releases the locking rod. This technique is entirely satisfactory in terms of locking but does however afford some risk of accidental unlocking when the knife handle has to be grasped firmly.

There are many systems for blade locking in the unfolded position for folding blade knives, each with its advantages and drawbacks and each with a varying degree of locking.

DISCLOSURE OF THE INVENTION

The aim of the invention is therefore to overcome the aforementioned drawbacks and thereby offer an alternative to these locking systems which is entirely satisfactory to the user thereof in terms of locking efficiency and elimination of any risk of accidental unlocking.

Another aim of the invention is in particular to provide a system for blade locking in the unfolded position that is reversible so that it can be mounted both on a knife for a left-handed user and on a knife for a right-handed user.

A further aim is also to provide a guard to protect the hand of a person using a knife fitted with a system for blade locking in the unfolded position according to the invention.

In other words, the aim is to provide an optimum system for blade locking in the unfolded position for folding blade knives.

In order to resolve the aforementioned problems, a system has thus been perfected for blade locking in the unfolded position, for a folding blade knife comprising a handle for a user to grasp the knife, and a blade pivotably mounted relative to this handle, the blade being pivotable between an unfolded position for use and a foldaway position for storage, wherein the blade is partially concealed in the handle.

According to the invention, the system of blade locking in the unfolded position comprises:

- first locking means provided on the top of the knife, capable of cooperating with the blade and adopting a first position of blade locking in the unfolded position and a second blade release position and;
- second locking means capable of cooperating with said first locking means and adopting a first position of locking said first locking means in the first blade locking position, and a second release position wherein said second locking means forces said first locking means to adopt the second blade release position.

In this way, the locking of the blade in the unfolded position is optimum.

To advantage and to avoid any risk of accidental unlocking, the system for blade locking in the unfolded position according to the invention comprises third locking means capable of cooperating with said second locking means and adopting a first position of locking said second locking means in the first locking position, and a second release position.

According to another inventive feature, the third locking means is capable of cooperating with the second locking means so that when said third locking means moves from the second release position to the first locking position, said second and first locking means move successively from the second release position to the first locking position.

In this way, this feature gives the user the opportunity to perform the knife blade locking and unlocking operation in a single action and using just one hand.

According to a preferred embodiment of the invention, said first locking means comes in the form of a leaf spring comprising a recess capable of cooperating, when said leaf spring is in the first locking position, with a finger provided on the upper part of the blade heel, the upper part of the blade heel being the part opposite the cutting edge of the blade.

The second locking means comes in the form of a first component pivotably mounted on the handle, said first component comprising a hook capable of cooperating, when said first component is in the first locking position, with a lug provided on said first locking means, in order to lock said first locking means in the first blade locking position, and, said first component comprises an eccentric part capable of cooperating, when said first component is in the second release position, with said first locking means so as to force them to adopt the second blade release position, the first component comprises a lever so that, by action on said lever, the first component can move into the first or second position.

According to another inventive feature, the lever of the second locking means constitutes, when they are in the first locking position, a guard for the protection of the user's hand.

According to a preferred embodiment of the invention, the third locking means comes in the form of a second component pivotably mounted on the handle, the second component comprising an abutment capable of cooperating, when said second component is in the first locking position, so as to prevent the rotation of said first component, said second component comprises a lever so that, by action on said lever, the second component can move into the first or second position.

To advantage, the first component comprises a boss for snapping on the second component.

According to a further inventive feature, in the system for blade locking in the unfolded position according to the invention, the first locking means is reversible in position and the second and third locking means are capable of being mounted on one side or the other of the handle.

This means in particular that the system for blade locking in the unfolded position can be adapted for use both on a knife designed for a left-handed user and on a knife designed for a right-handed user.

Preferably, the system for blade locking in the unfolded position is mounted on a knife of the so-called "outdoor" type, e.g., a survival knife or a tactical knife.

BRIEF DESCRIPTION OF THE DRAWINGS

Other features and advantages of the invention will become clearer from the description given thereof hereinafter, for information purposes and in no way restrictively, with reference to the appended figures, wherein.

DETAILED DISCLOSURE OF THE INVENTION

Figure 1:
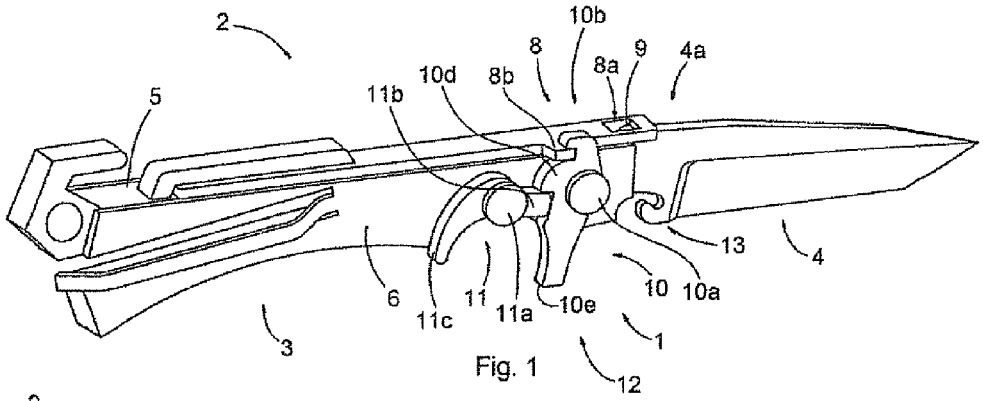
FIG. 1 is a perspective diagrammatic representation showing the inventive system for blade locking in the unfolded position mounted on a folding blade knife, the blade being in the unfolded position for use and the three locking means are in the first locking position.
Figure 2:
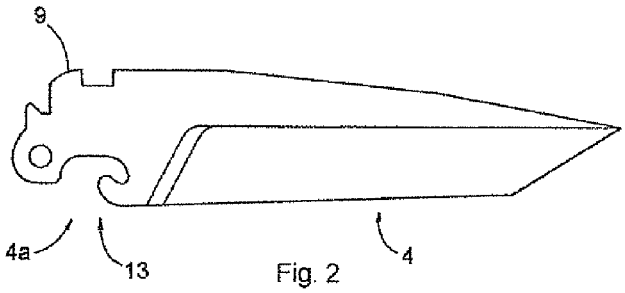
FIG. 2 is a diagrammatic front view representation showing the blade of the knife shown in FIG. 1.
Figure 3:
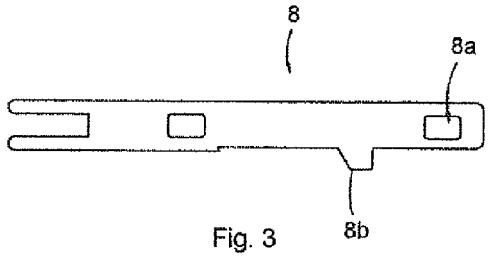
FIG. 3 is a diagrammatic front view representation showing the first locking means of the system for blade locking in the unfolded position according to the invention.
Figure 4:
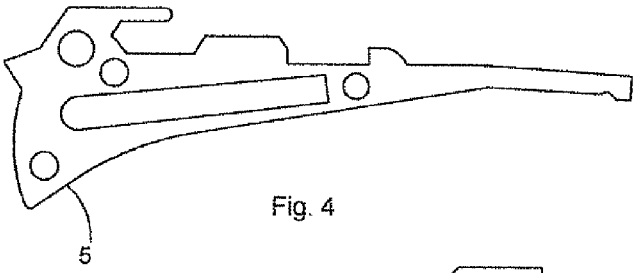
FIG. 4 is a diagrammatic front view representation showing the central core of the knife shown in FIG. 1.
Figure 5:
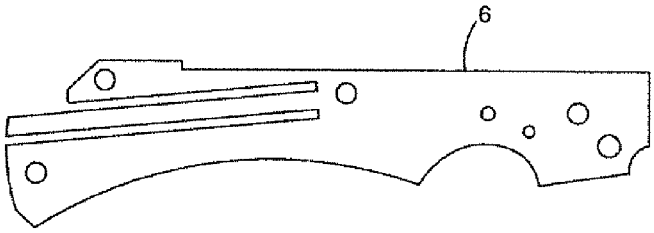
FIG. 5 is a diagrammatic front view representation showing one of the two plates of the handle of the knife shown in FIG. 1, the two plates being identical.
Figure 7:
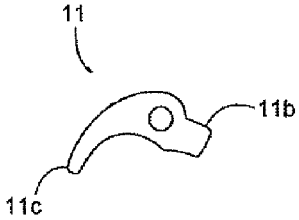
FIG. 7 is a diagrammatic front view representation showing the third locking means of the system for blade locking in the unfolded position according to the invention.
Figure 6:
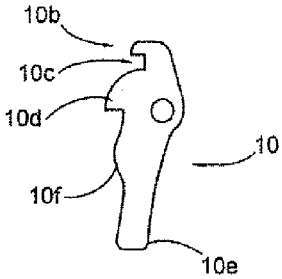
FIG. 6 is a diagrammatic front view representation showing the second locking means of the system for blade locking in the unfolded position according to the invention.
Figure 8:
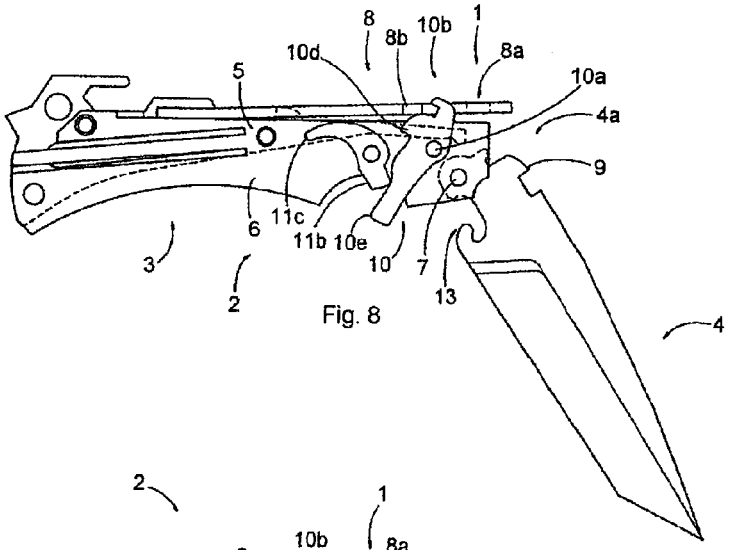
FIG. 8 is a diagrammatic front view representation of the knife shown in FIG. 1, the blade being partially folded and the first, second and third locking means being in the second release position.
Figure 9:
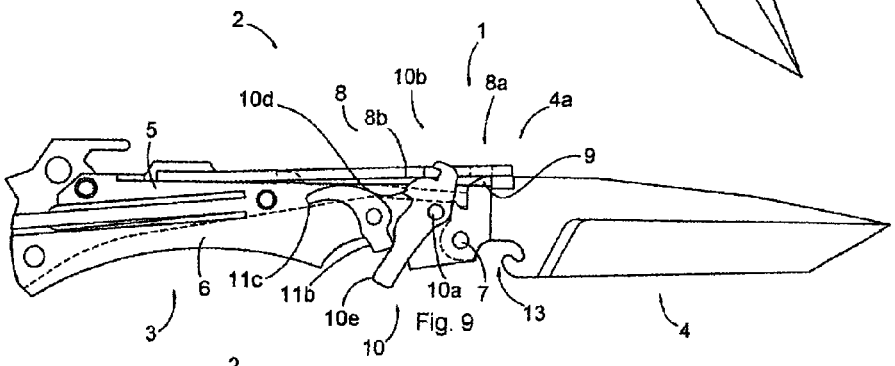
FIG. 9 is a diagrammatic representation similar to the one in FIG. 8, the blade being in the unfolded position for use and the first, second and third locking means being in the second release position.
Figure 10:
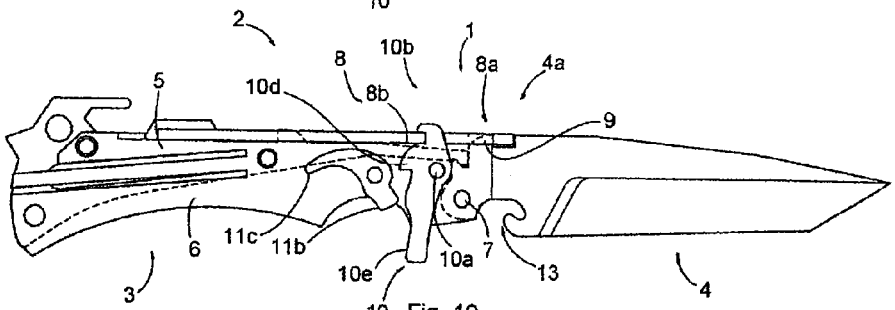
FIG. 10 is a diagrammatic representation similar to the one in FIG. 9, the first and second locking means being in the first locking position and the third locking means being in the second release position.
Figure 11:
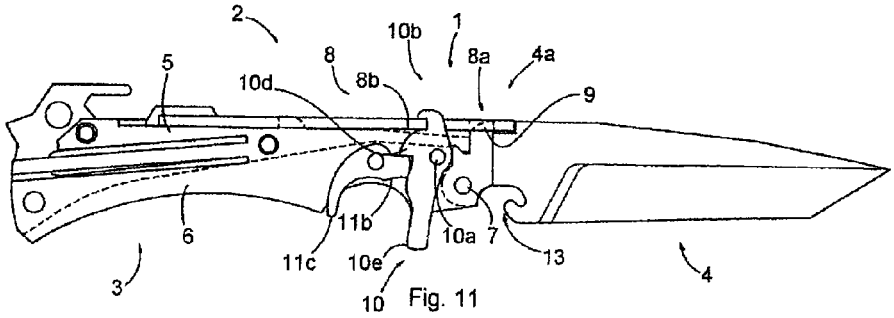
FIG. 11 is a diagrammatic representation similar to the one in FIG. 10, the first, second and third locking means being in the first locking position.

FIGS. 1 to 13 show a preferred embodiment of the system for locking (1) a blade (4) according to the invention, mounted on a folding blade knife (2), comprising a handle (3) for a user to grasp the knife (2), and a blade (4) pivotably mounted relative to this handle-forming part (3). The blade (4) is capable of pivoting so as to adopt either a first foldaway position for storage, in which it is partially concealed in said handle (3), or a second unfolded position for use.

The handle (3) is constituted by a component forming a central core (5), covered by two plates (6) of shapes that are ergonomic for the user's hand. The two plates (6) are preferably identical. The blade (4) is pivotably mounted about a pin (7) passing through the heel (4*a*) of said blade (4) and the end part of the two plates (6). The blade (4) is therefore capable of adopting two positions, a first foldaway storage position, wherein the blade (4) is abutted against the central-core-forming part (5) and partially concealed in the handle (3), between the two plates (6), and a second unfolded position for use, wherein the blade (4) is fully unfolded, in alignment with the handle (3) and abutted against the central-core-forming part (5).

The system for locking (1) a blade (4) according to the invention comprises first locking means that comes in the form of a leaf spring (8), provided on the top of the knife (2), in contact with the sections of the two plates (6) and secured to the central-core forming part (5). This leaf spring (8) is capable of adopting two positions, a first position of locking the blade (4) in the unfolded position and a second position of release of said blade (4). To this end, the leaf spring (8) comprises at its end opposite the blade (4), a recess (8*a*) capable of cooperating with a finger (9) provided on the upper part of the heel (4*a*) of the blade (4), opposite the leaf spring (8). Thus, when the blade (4) pivots, when it reaches abutment against the central-core-forming part (5), the finger (9) provided on the upper part of the heel (4*a*) of the blade (4) penetrates the recess (8*a*) formed in the leaf spring (8). The effect of this is to hook the leaf spring (8) on the heel (4*a*) of the blade (4) of the knife (2) and to lock said blade (4) in the unfolded position.

The system for locking (1) a blade (4) according to the invention further comprises second locking means capable of adopting two positions, a first position of locking said first locking means in the first position of locking the blade (4) in the unfolded position, and a second release position, wherein said second locking means forces said first locking means to adopt the second release position of the blade (4). To this end, the second locking means comes in the form of a first component (10) pivotably mounted about a pin (10*a*) passing through both said first component (10) and the end part of the two plates (6) of the handle (3). Said first component (10) comprises a hook (10*b*) produced in particular by the provision of a notch (10*c*) in the material of said first component (10). This notch (10*c*) is capable of cooperating, after said first component (10) has pivoted to a first locking position, with a lug (8*b*) provided on the lateral part of the leaf spring (8) so as to lock it in the locking position of the blade (4) of the knife (2) in the unfolded position. This first component (10) also comprises an eccentric part (10*d*) capable, after said first component (10) has pivoted in the reverse direction to a second release position, of lifting said leaf spring (8) and disconnecting the finger (9) of the blade (4) of the knife (2) from the recess (8*a*) of the leaf spring (8), in order to force said leaf spring (8) to adopt a second release position of the blade (4) of the knife (2). Finally, said first component (10) comprises a part, opposite the notch, forming a lever (10*e*) intended to allow the user to manipulate the first component (10) and to move it from the first to the second position.

The lever (10*e*) is extended by a pre-set length so that, when said first component (10) is in the first locking position, a guard is formed to protect the user's hand. To be more specific, said lever (10*e*) is extended in a direction substantially perpendicular to the direction of the general axis of the blade (4) of the knife (2).

The system for locking (1) a blade (4) according to the invention comprises to advantage third locking means capable of adopting two positions, a first position of locking said second locking means in the first locking position, and a second release position. To this end, said third locking means comes in the form of a second component (11) pivotably mounted about a pin (11*a*) passing through both said second component (11) and the end part of at least one of the two plates (6) of the handle (3). The second component (11) comprises an abutment (11*b*) capable of cooperating, after said second component (11) has pivoted to the first locking position, with said first component (10) so as to prevent it from pivoting and lock said first component (10) in the first locking position. The second component (11) comprises, a part, opposite to the abutment (11*b*), forming a lever (11*c*) and intended to allow the user to manipulate said second component (11) and to move it from the first to the second position.

The second component (11) is, to be more specific, capable of pivoting until it abuts against the eccentric part (10*d*) of the first component (10). And, to advantage, a boss (100 is formed on the first component (10), between the lever (10*e*) and the eccentric part (10*d*), so as to snap on the abutment (11*b*) of the second component (11) between said boss (100 and said lever (10*e*) in order to hold said second component (11) in the locking position and avoid any risk of accidental unlocking.

Said second component (11) also serves to lock said first component (10) in the first locking position which is also a position wherein the lever (10*e*) of said first component (10) forms a guard (12) for the user's hand. In other words, the second component (11) serves to lock said first component (10) in the guard position. This then serves to make the guard secure against any accidental unlocking caused, for example, by an impact on said guard (12) when the knife (2) is used for strike operations. The positioning of the user's hand behind the guard also reduces the risks of accidental unlocking since the hand serves to keep the guard in position and, therefore, to keep the first component (10) in the first locking position.

To further allow the blade (4) to be held in the second foldaway storage position, the blade (4) comprises in the lower part of its heel, intended to be concealed between the two plates (6), a hook (13). This hook (13) is capable of cooperating with a projection (not shown) provided on one of the two plates (6) and internally overlapping. In other words, the projection-forming element is provided on the wall of one of the two plates (6), between said two plates (6). Thus, when the blade (4) is folded away, the hook (13) cooperates with the projection to snap itself on. In this way, the blade (4) is held in the foldaway position and the risks of accidental unfolding of the blade (4) of the knife (2) are averted.

In a way already known to those skilled in the art, the projection provided between the two plates (6) may be implemented by a spring secured at one end to one of the inner walls of one of the plates (6) and fitted at the other end with a bead capable of cooperating with the hook-forming part (13) of the blade (4) of the knife (2).

Thus, when in use, the blade (4) of the knife (2) is for example, initially folded away and snapped in between the two plates (6) of the handle (3). The user must therefore exert sufficient force on the blade (4) by pulling on it to unlatch it and move it into the unfolded position for use. When the blade (4) reaches abutment on the central-core-forming part (5), and the finger (9) of said blade (4) penetrates the recess (8*a*) provided in the leaf spring (8), the user pivots the first component (10) by means of the lever (10*e*) of said first component (10) in order to move the first component into the first locking position of the leaf spring (8).

The user then pivots the second component (11) by means of the lever (11*c*) of said second component (11) in order to move the second component into the first locking position of the first component (10).

The blade (4) of the knife (2) is thus locked in position optimally and any accidental unlocking is eliminated.

The configuration of the pivoting first and second components (10, 11) acting as the second and third locking means, respectively, allows the user to perform the operations of locking and unlocking the blade (4) of the knife (2) in a single action. Indeed, by acting solely on the second component (11) and causing the second component (11) to pivot in order to move the second component (11) into the first locking position, it automatically moves the pivotable first component (10) into the first locking position. The operations to lock and unlock the second and third locking means may be performed one-handed.

Figure 12:
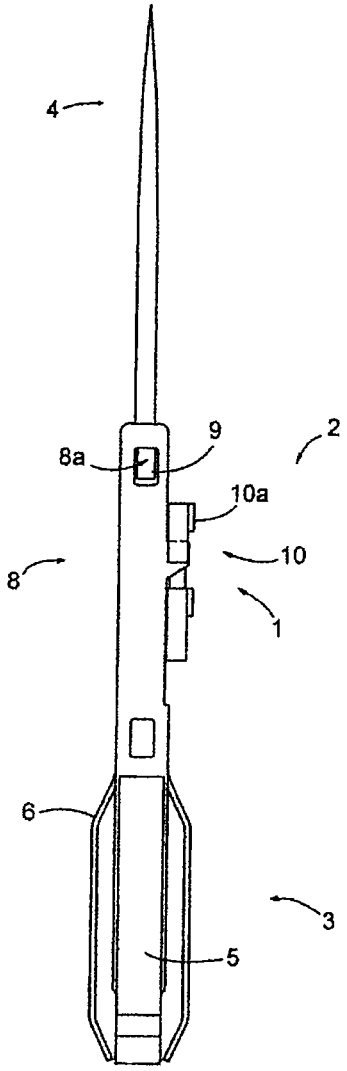
FIGS. 12 and 13 are diagrammatic representations seen from above of the knife shown in FIG. 1, the blade locking means being provided on the right and on the left of the knife respectively, these figures showing the reversibility of said locking means.
Figure 13:
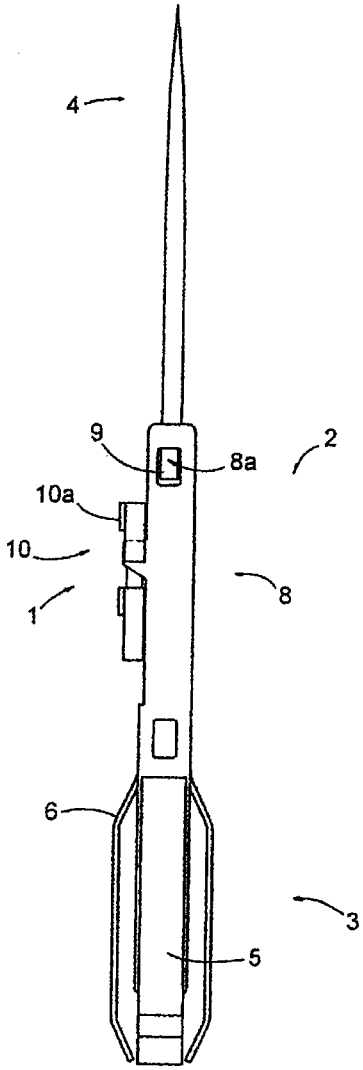

With reference to FIGS. 12 and 13, the first locking means is reversible in position and the second and third locking means is capable of being mounted on one side or the other of the handle-forming part (3). In this way, the system for locking (1) a blade (4) in the unfolded position is reversible and may be mounted both on a knife (2) for a left-handed user and on a knife (2) for a right-handed user.

As is clear from what has been said above, the invention thus provides a system for blade locking in the unfolded position for a knife (2) with a folding blade (4) wherein the locking of the blade (4) in the unfolded position is optimum. The inventive locking system (1) has the advantage of being reversible so that it can be mounted both on a knife (2) for a left-handed user and on a knife (2) for a right-handed user. The inventive locking system also provides a guard for protecting the user's hand and is of straightforward, safe and rational design.

It goes without saying that the invention is not restricted to the embodiment described above as an example but extends to all embodiments covered by the appended claims.

What is claimed is:

1. A folding knife comprising:

a handle for a user to grasp the knife, a blade pivotably mounted relative to the handle and pivotable between an unfolded position for use and a foldaway position for storage within the handle, and a system for locking the blade in the unfolded position, wherein the system comprises:

a leaf spring provided on a top of the knife to adopt either a locking position in which a recess of the leaf spring cooperates with a finger provided on a heel of the blade to lock the blade in its unfolded position, or a release position releasing the blade, a first component pivotably mounted on the handle to adopt either a locking position in which a hook of the first component cooperates with a lug provided on a lateral part of the leaf spring in order to lock the leaf spring in the locking position of the leaf spring, or a release position in which an eccentric part of the first component cooperates with the leaf spring in order to force the leaf spring to adopt the release position of the leaf spring, and the first component comprises a lever to move the first component between the locking position and the release position of the first component.

2. The folding knife of claim 1, further comprising a second component pivotably mounted on the handle, the second component comprising an abutment cooperating, when the second component is in a locking position, to prevent rotation of the first component, and a lever to move the second component between the locking position and a release position of the second component.

3. The folding knife of claim 2, wherein the first component comprises a boss for the second component to be snapped on.

4. The folding knife of claim 2, wherein the leaf spring is reversible in position and the first component and the second component are capable of being mounted on either side of the handle.

5. The folding knife of claim 1, wherein the lever of the first component serves, when the first component is in the locking position, as a guard to protect a hand of the user.

* * * * *